US009701085B1

(12) United States Patent
Sticker et al.

(10) Patent No.: US 9,701,085 B1
(45) Date of Patent: Jul. 11, 2017

(54) RADIAL PRESS

(71) Applicant: UNIFLEX HYDRAULIK GMBH, Karben (DE)

(72) Inventors: Patrick Sticker, Bad Vilbel-Dortelweil (DE); Carsten Baumgartner, Laubach (DE); Eduard Weikum, Butzbach (DE)

(73) Assignee: Uniflex Hydraulik GmbH, Karben (DE)

( * ) Notice: Subject to any disclaimer, the term of this patent is extended or adjusted under 35 U.S.C. 154(b) by 0 days.

(21) Appl. No.: 15/339,385

(22) Filed: Oct. 31, 2016

(51) Int. Cl.
*B30B 7/04* (2006.01)
*B21D 41/00* (2006.01)
*B21D 39/04* (2006.01)

(52) U.S. Cl.
CPC ..... *B30B 7/04* (2013.01); *B21D 39/046* (2013.01); *B21D 39/048* (2013.01)

(58) Field of Classification Search
CPC ..... B30B 7/04; B21D 39/046; B21D 39/048
USPC ..... 72/402
See application file for complete search history.

(56) References Cited

U.S. PATENT DOCUMENTS 4,854,031 A * 8/1989 Eisenzimmer ..... B21D 39/048 29/237
6,257,042 B1 * 7/2001 Valimaki ..... B21D 39/048 29/237
6,324,884 B1 * 12/2001 Barjesteh ..... B21D 39/046 29/237
7,043,806 B2 * 5/2006 Schrock ..... B21D 39/048 29/237
8,381,645 B2 * 2/2013 Hejplik ..... B21D 39/048 100/269.01

FOREIGN PATENT DOCUMENTS

DE 4135465 A1 4/1993
DE 19912976 A1 9/2000

* cited by examiner

*Primary Examiner* — David B Jones
(74) *Attorney, Agent, or Firm* — Myers Wolin, LLC

(57) ABSTRACT

A radial press is provided for the radial deformation of a workpiece centrically to a pressing axis, having two yokes and a pressing tool that comprises a pressing jaw set received in a tool installation space defined between the yokes with pressing jaws arranged concentrically round the pressing axis, wherein both yokes are movable relative to one another by means of a drive system along a drive axis arranged perpendicularly to the pressing axis and the spacing of the pressing jaws from the pressing axis depends on the position of the two yokes relative to one another.

13 Claims, 1 Drawing Sheet

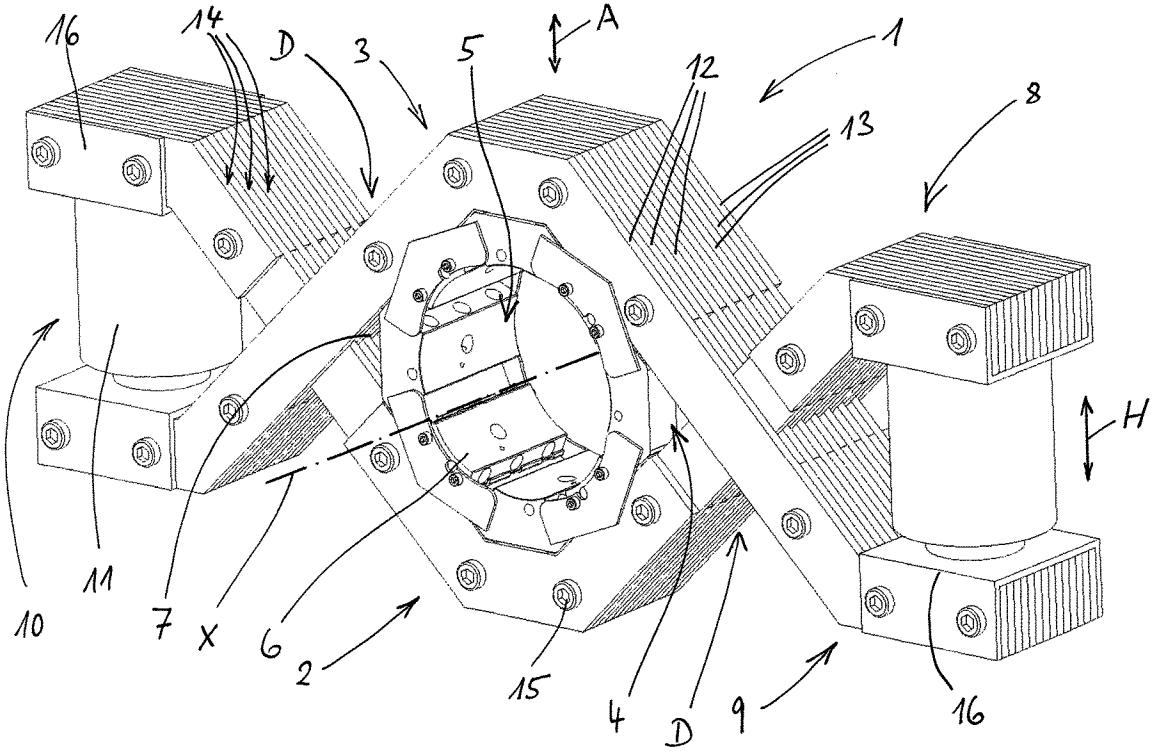
H
8
1
13
12
A
5
3
D
14
16
16
9
D
4
15
2
6
X
7
11
10

RADIAL PRESS

FIELD OF THE INVENTION

The present invention relates to a radial press for the radial deformation of a workpiece centrically to a pressing axis, having two yokes and a pressing tool that comprises a pressing jaw set received in a tool installation space defined between the yokes with pressing jaws arranged concentrically round the pressing axis, wherein both yokes are movable relative to one another by means of a drive system along a drive axis arranged perpendicularly to the pressing axis and the spacing of the pressing jaws from the pressing axis depends on the position of the two yokes relative to one another.

BACKGROUND

Radial presses of the aforementioned type, known as "yoke presses," are employed for a variety of uses, for example, for connecting fittings to hose lengths in the context of manufacturing installation-ready hydraulic hose lines. A widespread construction is known, for example, from DE 4135465 A1. In this frameless yoke press, two drawbars, which are fixed at their end side to the upper yoke and are each connected with their opposing lower end to the piston of a hydraulic cylinder, penetrate the lower yoke laterally outside the tool installation space. DE 19912976 A1 discloses a differently constructed yoke press in which a central hydraulic cylinder arranged under the lower yoke acts thereon, wherein the force flow to the upper yoke is ensured by means of a frame with two drawbars arranged laterally outside the tool installation space.

Radial presses of this type have proven themselves for normal uses in practice. On proper use, for example, connections with a long service life between two components (e.g. hose length and connector fitting) that meet very high standards can be made.

For the radial compression of certain components using the known radial presses configured as yoke presses, however, it is disadvantageous that the components must be lifted for this purpose to a significant distance from the floor (to the level of the pressing axis). This results in problems, particularly with components that are long and heavy, difficult to handle and/or fixed close to the floor.

In view of this prior art, an object of the present invention is further to improve radial presses of the type mentioned in the introduction with regard to their usage possibilities, specifically such that the processing, in particular, of components that are heavy, difficult to handle and/or fixed close to the floor is facilitated.

SUMMARY

The above object is achieved in accordance with the present disclosure in that in a radial press of this generic type, the two yokes penetrate one another on both sides of the tool installation space, wherein the drive system comprises two synchronously acting drive units arranged outside the two penetration zones and acting on yoke extensions.

Thus, in the radial press described, two synchronously acting drive units arranged on either side of the tool installation space act directly on the two yokes, specifically on their yoke extensions lying outside the penetration zones. The force required for the compression of the workpiece can thus act directly between the two yokes in that the yokes are moved toward one another by the same amount in the region of the tool installation space as the yoke extensions are moved—under the effect of the two drive units—away from one another. The two drive units can thus be arranged at the same height as the tool installation space or the tool installed therein. In other words, the two drive units and the tool can lie substantially on one line. The overall height of the radial press can be minimized accordingly. Ideally, the overall height can be reduced to the amount determined by the yokes—in the open position of the radial press—and the pressing axis can accordingly extend low above the floor. This is decisive for solving the aforementioned problem. In addition, since the two drive units act directly on the two yokes, i.e. the yoke extensions, and conduct the pressing force directly into them, the radial press according to the invention doesn't need a frame. The invention can thereby even result in an increase in precision and reproducibility since a reproducibility-impairing flexibility of the frame does not arise. The possible omission of a frame can also have advantageous effects with regard to the weight, the space requirement and the manufacturing costs. It is finally to be mentioned as a possible advantage of practical relevance that the two yokes—given a suitable configuration of the penetration zones—can stiffen one another so that with an asymmetrical placement of the workpiece in the tool offset along the pressing axis, the risk of tilting of the yokes relative to one another is reduced. Such mutual stiffening of the two yokes against one another in the region of the penetration zones, which are arranged on both sides of the tool installation space and in which the two yokes penetrate or cross one another, and the corresponding mutual guidance of the yokes against one another that is possible therefrom, can also be used additionally with the advantages outlined for (frameless or frame-mounted) radial presses in which the drive system is conventionally configured (i.e. according to the prior art described in the introduction), wherein in this case, the yoke extensions characteristic of the inventive radial press can also be omitted.

For the purpose of the present disclosure, the drive unit that engages the two associated yoke extensions is to be understood to be any technical apparatus by means of which the two yoke extensions in question can be moved away from one another in order to move the yokes in the region of the tool installation space toward one another by the corresponding amount. Coming into consideration, in particular, are hydraulic or electrical actuators (e.g. hydraulic cylinders or electrical spindle drives) or mechanical boosters (e.g. in the form of wedge gears) connected, where relevant, downstream thereof. However, purely mechanical drive units, for example eccentrics, are also conceivable. Such purely mechanical drive units (e.g. eccentric drive units) would then preferably be coupled to one another via a coupling apparatus actuated by a single common actuator (e.g. a hydraulic cylinder).

Preferably, the two drive units have operating directions parallel to one another and to the drive axis. In this case, optimum force conditions result. In an individual case, however, a non-parallel orientation of the operating directions of the two drive units to one another can prove to be suitable, although in this case also, the resultant drive force typically extends parallel to the drive axis.

If the two drive units each comprise at least (see above) one hydraulic cylinder, then it proves to be positive that due to the kinematic conditions (closing of the tool on moving apart of the yoke extensions), an extension of the hydraulic cylinder (through moving out of the piston rod) can correspond to the closing of the tool. Accordingly, for closing the radial press, i.e. for the pressing of the workpiece, an application of pressure to the respective piston working chamber (and not the smaller-area piston rod working chamber) takes place, so that with the given dimensions of the hydraulic cylinder and the pre-determined hydraulic pressure, maximum pressing forces can be achieved. This is also an aspect of the provision of a particularly compact and nevertheless powerful radial press. For the return stroke serving for the opening of the radial press, the hydraulic cylinder can be configured to be double-acting; or the return stroke can be effected by a return spring.

Another preferred embodiment of the present disclosure is characterized in that each drive unit comprises a plurality of drive elements (functionally) connected in parallel. In particular, the individual drive elements of each drive unit can be arranged mutually adjacent in the direction of the pressing axis. Thus, firstly, the existing structural space can be optimally utilized, which favors a particularly compact embodiment of the inventive radial press. Furthermore, this development can be advantageous with regard to efficiency since the number of the respective activated drive elements (e.g., pressurized hydraulic cylinders) can be selected depending on the respective task and thus optimally adapted thereto. The activation of the individual drive elements can also take place depending on the respective phase within the press cycle, for example, in that during the closing return stroke (and during the opening of the radial press) only one of the drive elements is active, whereas during power pressing, all the drive elements are active.

In many respects, it is particularly advantageous if the yokes each comprise a plurality of mutually parallel lamellae which are held outside the penetration zones arranged at a spacing from one another by means of spacing elements. This development is distinguished not only by an optimum material utilization in the sense that ideal force flow conditions in the lamellae can come about for typical loading conditions in a yoke press, but also by particularly attractive production costs, not least with regard to a possible building-block concept of similar radial presses with yokes of different widths. Particularly in view of this, the embodiment of the drive units described above with a plurality of drive elements connected in parallel is also especially attractive. The lamellae preferably consist of steel sheet with a thickness that is constant over the whole extent of the lamellae, and the individual lamellae preferably all have a consistent thickness. Particularly advantageously, the lamellae are cut out of a steel sheet by means of a laser beam. Particularly preferably, the spacing elements arranged between the lamellae are formed by spacing plates, the thickness of which is slightly greater than the thickness of the lamellae. In order to form a block from the lamellae and the spacing elements arranged therebetween, known joining techniques (screw fastening, riveting, pinning, gluing, welding, soldering, etc.) are usable.

In the context of the present invention, linear guides are preferably provided which—with a movement axis oriented parallel to the drive axis—act between the two yokes. Such linear guides can be provided in the region of the penetration zones of the two yokes. However, a different placement is also conceivable, for example, on the yoke extensions, e.g., in the region of their ends.

According to yet a further preferred development of the present invention, it is provided that the two yokes can be entirely separated from one another. With the present inventive radial press, this can be realized with relatively little effort, specifically in particular if the yokes—according to the design in their penetration regions—are also configured to be lamella-like in the region of the yoke extensions. Thus in a particularly preferred manner, the upper yoke can be raised upwardly from the lower yoke once the drive units have been removed from the space between the two respectively assigned yoke extensions. For this purpose, the engagement of the two drive units on at least one of the two respectively assigned yoke extensions is therefore preferably separable. The advantage of such a radial press is that—also with a separable embodiment of the tool—a radial compression can take place at any desired positions of the workpiece, thus for example also in the case of an endless pipe to be laid from above into the completely opened radial press.

BRIEF DESCRIPTION OF THE DRAWINGS

The present invention will now be described by reference to a preferred exemplary embodiment illustrated in the drawing.

The FIGURE shows—in a perspective view—the corresponding exemplary embodiment in a partially closed state.

DETAILED DESCRIPTION OF THE PREFERRED EMBODIMENTS

The radial press 1 shown in the drawing and serving for the centric radial deformation of a workpiece (not shown) comprises two yokes, specifically a lower yoke 2 and an upper yoke 3, as well as a pressing tool 4. This tool is conventionally designed in that it comprises a pressing jaw set 5 with pressing jaws 6 arranged concentrically around a pressing axis X, said jaw set being received in a tool installation space 7 defined between the yokes 2, 3. The two yokes 2, 3 are movable relative to one another along a drive axis A disposed perpendicularly to the pressing axis X. Depending on the position of the two yokes 2, 3 relative to one another, the spacing of the pressing jaws 6 from the pressing axis X changes.

On both sides of the tool installation space 7, the two yokes 2, 3 penetrate one another in comb-like manner. Outside the two penetration zones D, therefore, two end-side yoke extensions 8 of the lower yoke 2 lie above the end-side yoke extensions 9 of the upper yoke 3.

The drive system by means of which the two yokes 2, 3 can be moved relative to one another along the drive axis A comprises two synchronously acting drive units 10 in the form of double-acting hydraulic cylinders 11, the respective operating direction H of which is oriented parallel to the drive axis A, said drive units being arranged outside the two penetration zones D and engaging on the two respectively associated yoke extensions 8, 9. An application of pressure on the respective piston-side working chamber ("piston working chamber") has the effect of closing the press; in order to open the press, however, pressure is applied to the piston rod-side working chambers ("piston rod working chambers").

The two yokes 2, 3 each comprise a plurality of lamellae 12 parallel to one another. With the exception of the penetration zones D, i.e. both in the region of the tool installation space 7 and also in the region of the yoke extensions 8, 9, spacing elements 14 formed by spacing plates 13, by means of which the lamellae 12 are held at a pre-set spacing from one another, are received between the lamellae 12. The lamellae 12 and the spacing plates 13, the thickness of which is slightly greater than the thickness of the lamellae 12, respectively form a block in the region of the tool installation space 7 and in the regions of the two yoke extensions 8, 9, for which purpose they are clamped against one another by means of the bolts 15. In the region of the yoke extensions 8, 9, the blocks formed by the stacked lamellae 12 and spacing plates 13 are encompassed by a clamp-like shoe 16 laterally and at the side facing toward the respective opposite yoke extension, wherein the respective hydraulic cylinder 11 is supported on the two respectively associated shoes 16. The shoes 16 are thus further specifically configured with regard to the connection of the respective hydraulic cylinder 11 (or another drive element).

In order to be able to separate the two yokes 2, 3 completely from one another, according to the above description, a modification of the exemplary embodiment shown would need to be made such that the spacing plates 13 (together with the two hydraulic cylinders 11) provided in the region of the yoke extensions 8, 9 are easily removed. A favorable embodiment in this regard provides that the spacing plates 13 and the respective clamp-like shoe 16 form an integral component into the grooves of which provided between the spacing plates, the lamellae 12 of the relevant yoke 2, 3 are insertable.

What is claimed is:

1. A radial press (1) for the radial deformation of a workpiece centrically to a pressing axis (X), comprising:

two yokes (2, 3) having a tool installation space defined therebetween; and a pressing tool (4), the pressing tool comprising a pressing jaw set (5) received in the tool installation space (7) between the yokes (2, 3), wherein the pressing jaw set comprises pressing jaws (6) arranged concentrically around the pressing axis (X), wherein both yokes (2, 3) are movable relative to one another by means of a drive system along a drive axis (A) defined perpendicularly to the pressing axis (X) and a spacing of the pressing jaws (6) of the pressing jaw set from the pressing axis (X) depends on a position of the two yokes (2, 3) relative to one another, characterized in that the two yokes (2, 3) pass through one another outside of the tool installation space (7) at two penetration zones, wherein the drive system comprises two synchronously operating drive units (10) arranged opposite the two penetration zones (D) from the tool installation space and acting on extensions (8, 9) of the two yokes.

2. The radial press of claim 1, wherein the two drive units (10) have operating directions (H) parallel to one another and to the drive axis (A).

3. The radial press of claim 1, wherein each drive unit (10) comprises a plurality of drive elements connected in parallel.

4. The radial press of claim 3, wherein the individual drive elements are arranged mutually adjacent in the direction of the pressing axis (X).

5. The radial press of claim 1, wherein the yokes (2, 3) each comprise a plurality of mutually parallel lamellae (12) that are held, except in the region of the penetration zones (D), arranged at a spacing from one another by means of spacing elements (14).

6. The radial press of claim 5, wherein the lamellae (12) are made from steel sheet of consistent thickness.

7. The radial press of claim 5, wherein the spacing elements (14) are formed by spacing plates (13) the thickness of which is slightly greater than the thickness of the lamellae (12).

8. The radial press of claim 5, wherein clamp-like shoes are provided about the extensions (8, 9) of the yoke, each shoe at least partially encompassing a block formed by the lamellae (12) and the spacing elements (14).

9. The radial press of claim 1, wherein the drive units (10) comprise hydraulic or electrical actuators and mechanical boosters connected downstream thereof.

10. The radial press of claim 1, wherein the drive elements (10) comprise hydraulic cylinders (11) wherein a pressure application to the respective piston working chamber has the effect of a closing of the radial press (1).

11. The radial press of claim 1, wherein the yokes (2, 3) are entirely separable from one another.

12. The radial press of claim 11, wherein the engagement of both the drive units (10) on at least one of the yoke extensions (8, 9) is separable.

13. The radial press of claim 1, wherein linear guides with a movement axis oriented parallel to the drive axis (A) act between the two yokes (2, 3).

* * * * *